United States Patent [19]

Vonlanthen et al.

[11] 4,301,711

[45] Nov. 24, 1981

[54] FLEXIBLE AMMUNITION CHANNEL

[75] Inventors: Alfred Vonlanthen, Dübendorf; Heinz Lienhard, Baar, both of Switzerland

[73] Assignee: Werkzeugmaschinenfabrik Oerlikon-Bührle AG, Zürich, Switzerland

[21] Appl. No.: 76,244

[22] Filed: Sep. 17, 1979

[30] Foreign Application Priority Data

Sep. 25, 1978 [CH] Switzerland ..... 9970/78

[51] Int. Cl.[3] ..... F41F 9/00

[52] U.S. Cl. ..... 89/33 BB; 193/25 AC

[58] Field of Search ..... 89/33 BB; 193/25 R, 193/25 AC, 25 E, 25 FT

[56] References Cited

U.S. PATENT DOCUMENTS 2,479,633 8/1949 MacKenzie ..... 89/33 BB
2,890,779 6/1959 Aumann ..... 193/25 AC

FOREIGN PATENT DOCUMENTS 779026 3/1935 France ..... 193/25 AC

*Primary Examiner*—Stephen C. Bentley
*Attorney, Agent, or Firm*—Werner W. Kleeman

[57] ABSTRACT

A flexible ammunition channel comprising a multiplicity of elements connected with one another by hinges or pivots. The side walls of the ammunition channel, which are directed perpendicular to the bending plane of such ammunition channel, are constituted by flexible guide elements extending through the individual elements of the ammunition channel. The ammunition is precisely guided with small resistance against forward feed or advance thereof.

7 Claims, 8 Drawing Figures

FLEXIBLE AMMUNITION CHANNEL

BACKGROUND OF THE INVENTION

The present invention relates to a new and improved construction of a flexible ammunition channel for feeding ammunition from a magazine to a weapon. More specifically, the ammunition channel of the present invention is of the type comprising ammunition channel elements connected with one another by hinges or pivots, wherein the hinge axes are directed perpendicular to a plane of bending of such flexible ammunition channel.

According to a heretofore known ammunition channel of this type, as disclosed in German Pat. No. 644,053, funnel-shaped mutually interengaging elements are likewise interconnected by hinges. The elements delimit the ammunition movement not only in a direction perpendicular to the bending plane, but also form the side walls of the ammunition channel which are perpendicular to such bending plane. Therefore, a relatively large number of elements are needed in order to obtain the desired curvature of the ammunition channel. The mutually interengaging or telescoping elements do not afford any exact guiding of the ammunition and the feed of the belt is accomplished against an appreciable resistance. The step-shaped transitions from one element to the other precludes any sliding back of the cartridge belt. Additionally, there is only possible a slight length compensation of the ammunition channel.

SUMMARY OF THE INVENTION

Therefore, with the foregoing in mind it is a primary object of the present invention to provide a new and improved construction of flexible ammunition channel which is not afflicted with the aforementioned drawbacks and limitations of the prior art proposal discussed above.

Another and more specific object of the present invention aims at the provision of a new and improved construction of flexible ammunition channel which is relatively simple in design, economical to manufacture, extremely reliable in operation, and specifically, affords for exact guiding of the ammunition and relatively low resistance against the forward feed or advance of such ammunition.

Another and more specific object of the present invention aims at providing a new and improved construction of flexible ammunition channel wherein, in a simple manner, there is afforded exact guiding of the ammunition and small feed resistance thereof.

Yet a further significant object of the present invention aims at a novel construction of flexible ammunition channel employing relatively few elements for achieving the requisite flexibility thereof, while affording precise ammunition guiding against low feed resistance.

Now in order to implement these and still further objects of the invention, which will become more readily apparent as the description proceeds, the flexible ammunition channel of the present development is manifested by the features that the side walls of the ammunition channel are constituted by flexible guide elements, directed essentially perpendicular to the bending plane of the ammunition channel and secured at an end element of such ammunition channel. These guide elements are guided in the hingedly interconnected elements of the ammunition channel and protrude into a recess provided at the other end element of the ammunition channel.

One of the major advantages afforded with the invention especially resides in the fact that there are only required very few elements in order to achieve good flexibility of the ammunition channel and precise guiding of the ammunition. Since the side walls of the ammunition channel are formed by continuous, smooth guide elements, minimum friction conditions prevail.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
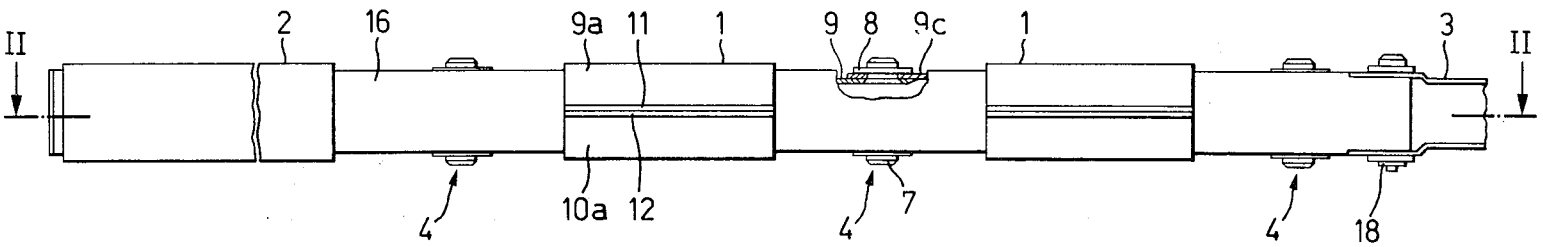
FIG. 1 is a side view of a first exemplary embodiment of ammunition channel constructed according to the invention.

Describing now the drawings, the exemplary embodiment of flexible ammunition channel shown in FIGS. 1 to 5 will be seen to comprise a plurality of ammunition channel elements, here shown as constituted by two channel elements 1 and two end elements 2 and 3 which are pivotably connected with one another. For the purpose of pivotably interconnecting the channel elements 1 with one another there are provided any suitable pivot connections, here shown in the form of hinges or pivot means 4 arranged essentially perpendicular to a plane of bending of the ammunition channel. The end elements 2 and 3 are secured in any suitable and therefore not further illustrated manner with an ammunition container or box and at a weapon, respectively. The end element 3 which is attached to the weapon has only been partially shown in the drawings as a matter of convenience in illustration.

Figure 3:
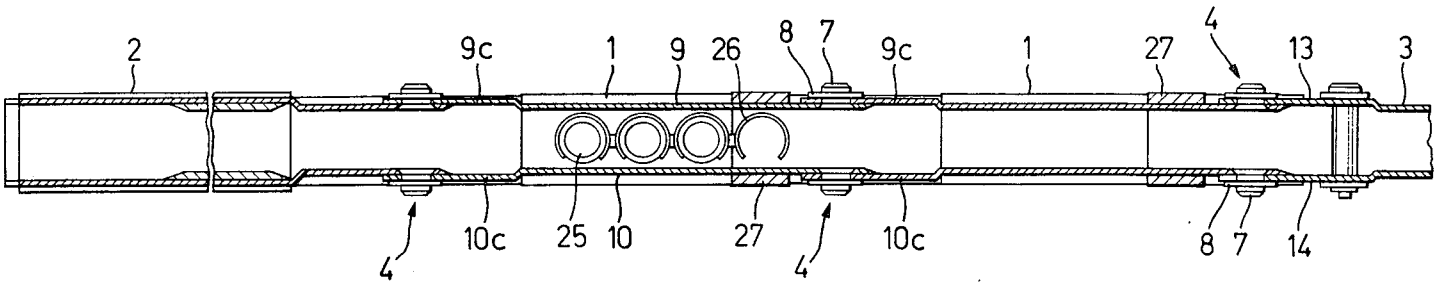
FIG. 3 is a sectional view of the arrangement of FIG. 2, taken substantially along the line III—III thereof.

The elements 1 which may be fabricated of sheet metal, but of course can also be manufactured from another suitable material, form two walls 9 and 10 of the ammunition channel, these walls extending essentially parallel to the bending plane of the ammunition channel, as best recognized by referring to FIG. 3. At the intermediate region the walls 9 and 10 transform into two respective parallel wall portions 9*a* and 10*a* arranged in the lengthwise direction of the ammunition channel perpendicular to the bending plane. These wall portions or sections 9*a* and 10*a* are shorter than the walls 9 and 10 and are each provided with a respective flange portion 11 and 12, as best recognized by referring to FIGS. 1, 2 and 4. The mutually abutting flange portions 11 and 12 of the wall portions 9*a* and 10*a* are attached to one another in any suitable manner, typically for instance by welding. At the transition location of the walls 9 and 10 with the wall portions 9*a* and 10*a* these are formed lengthwise directed, fold-shaped or crimped sections or grooves 9*b* and 10*b*, as shown in FIGS. 2 and 4.

As clearly seen by reverting to FIG. 3, the walls 9 and 10 of an element 1, viewed in the lengthwise direction, have a widened portion 9*c* and 10*c*, respectively, at one side or end thereof, with which telescopically engage or interfit the walls 9 and 10 of the preceeding element 1 or end element 2, as the case may be. In a similar fashion the end element 3 is provided with a widened or enlarged portion 13, 14 and overlapping the preceeding element 1. At this region there are mounted the hinges or pivots 4 or equivalent structure, which, in each case, comprise a pivot bearing or support 7, piercingly extending through the widened portions 9*c*, 10*c* or 13, 14, as the case may be, and sunk into the wall 9 or 10 of the preceeding element 1 or end element 2. Each such hinge or pivot means 4 further comprises a securing ring 8 which is mounted at the outer surface of the ammunition channel. Both the transition from the walls 9 and 10 to the related widened portion 9*c* and 10*c*, respectively, and also the ends of the walls 9 and 10 which face away from the widened portion 9*c* and 10*c*, respectively, are bevelled or appropriately formed such that there do not exist any sharp edges internally of the ammunition channel.

The ammunition channel is provided with two side walls, arranged essentially perpendicular to the bending plane of such ammunition channel, which are advantageously constructed in the form of two elastic guide elements 16 and 17. Preferably, the guide elements 16 and 17 are fabricated of smooth spring steel band or strip. The guide elements or bands 16 and 17 are attached at the end element 3 by means of the fixing or pin shafts 18 and 19, respectively, or equivalent structure, and extend through both of the channel elements 1. More specifically, these through passing elastic guide elements or bands 16 and 17 are guided by the fold-shaped portions or grooves 9*b* and 10*b* at the transition from the walls 9 and 10 to the shorter wall portions 9*a* and 10*a*, respectively, as particularly evident by referring to FIG. 4. The opposite ends of the elastic guide elements 16 and 17, in other words the ends which face away from the fixing shafts 18 and 19, engage in a respective recess 20 and 21 of the end element 2, as clearly shown in FIGS. 2 and 5. These recesses or channels 20 and 21, corresponding in section or shape to the guide elements 16 and 17 and configured to receive the same, are formed between an inner part 22 of the end element 2 and a respective U-shaped profile or sectional element 23 and 24 secured at the inner part 22, as particularly well shown in FIG. 5.

Figure 2:
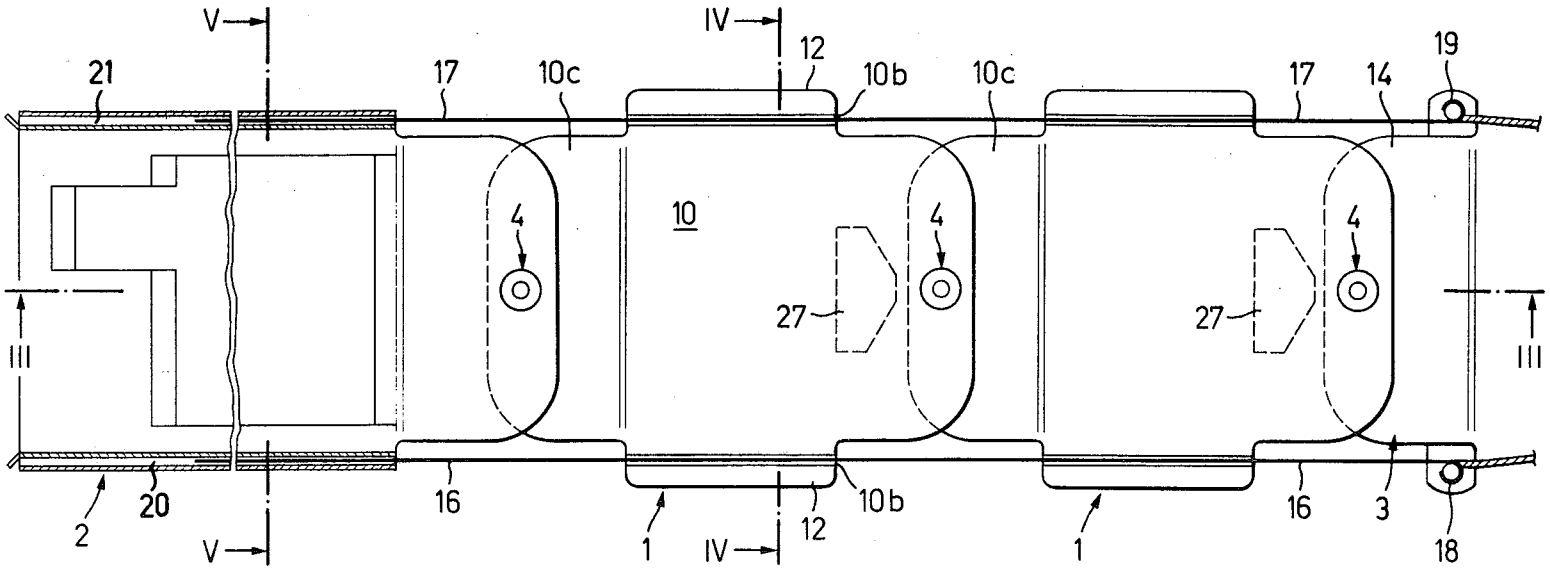
FIG. 2 is a sectional view of the ammunition channel of FIG. 1, taken substantially along the line II—II thereof.
Figure 4:
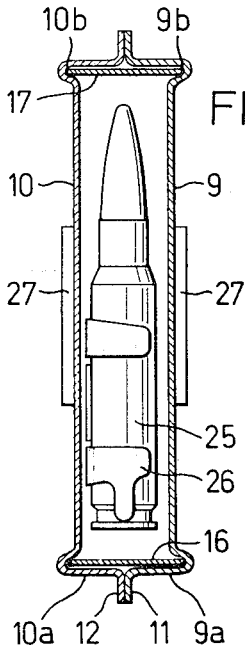
FIG. 4 is a sectional view of FIG. 2, taken substantially along the line IV—IV thereof.
Figure 5:
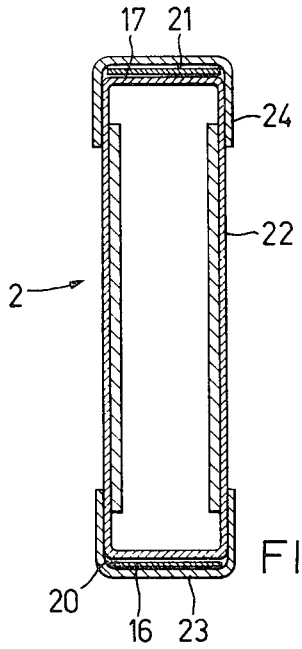
FIG. 5 is a sectional view of FIG. 2, taken substantially along the line V—V thereof.

In order to obtain the beneficial result that the curvature of the ammunition channel is essentially uniform throughout the entire channel length, stop or impact surfaces 27 are provided at the elements 1, as shown in FIGS. 2, 3 and 4. These stop or impact surfaces 27 or equivalent stop or impact means, limit the rocking of the next following element 1 or end element 3 about the hinge or pivot means 4 in both pivot directions, for instance so as not to pivot through an angle exceeding 30° by way of example.

FIGS. 3 and 4 show the arrangement of the ammunition in the ammunition channel of the first exemplary embodiment portrayed in FIGS. 1 to 5. The cartridges 25 are located in an ammunition belt 26 only partially shown. The lengthwise axes of these cartridges 25 are located in the plane of bending of the ammunition channel.

Figure 6:
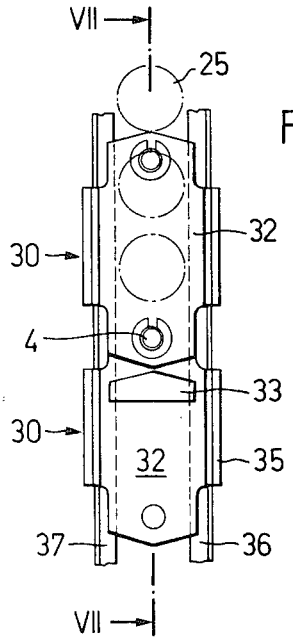
FIG. 6 is a fragmentary illustration of a second exemplary embodiment of ammunition channel according to the invention.
Figure 7:
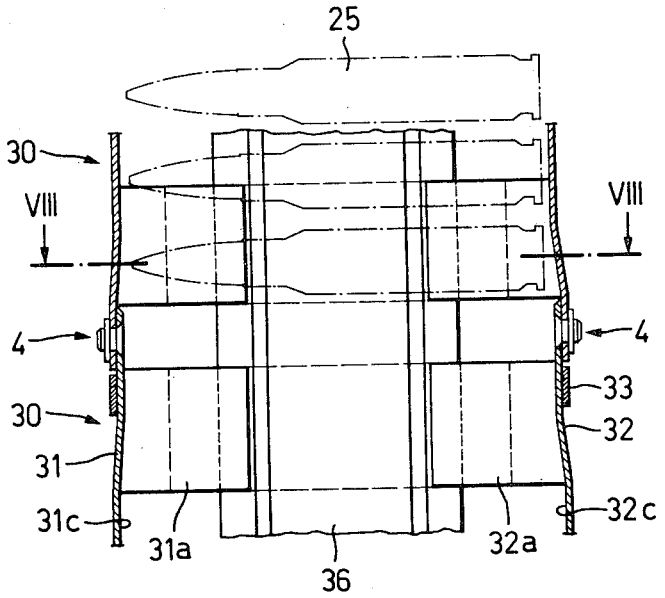
FIG. 7 is a sectional view of the ammunition channel of FIG. 6, taken substantially along the line VII—VII thereof.
Figure 8:
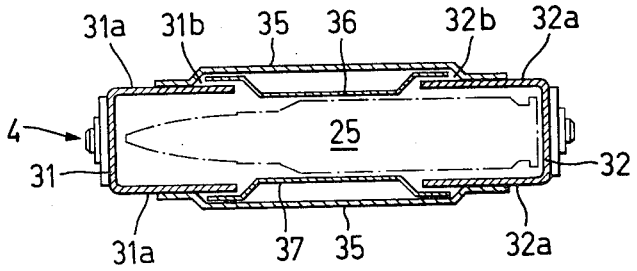
FIG. 8 is a sectional view of the ammunition channel of FIG. 6, taken substantially along the line VIII—VIII thereof.

Continuing, FIGS. 6 to 8 illustrate a second exemplary embodiment of ammunition channel constructed according to the invention, wherein the lengthwise axes of the cartridges 25 are perpendicular to the bending plane of the ammunition channel, i.e. directed essentially parallel to the hinge or pivot axes. There have only been shown as a matter of convenience and for drawing simplification purposes the intermediate elements 30 corresponding to the elements 1 of the first exemplary embodiment discussed above with reference to FIGS. 1 to 5. The elements 30 form two walls 31 and 32, extending parellel to the bending plane, and equipped with widened or enlarged portions 31*c* and 32*c*, respectively, by means of which they engage over or interfit with the walls 31 and 32 of the preceeding element 30. At this region there are arranged the hinges or pivots 4 corresponding to the like referenced structure of the first exemplary embodiment. Pivoting of the elements 30 about the related hinge or pivot 4 is limited in both rotational or pivot directions by providing suitable stop or impact surfaces 33 or equivalent impact means, as shown in FIGS. 6 and 7. The elements 30 have wall portions 31*a* and 32*a*, directed perpendicular to the bending plane, these wall portions, viewed in the lengthwise direction of the ammunition channel, being shorter than the walls 31 and 32 and shorter than the spacing between two successive hinges or pivots 4. The wall portions 31*a* and 32*a* located on one side of the related cartridges 25 are interconnected in each case by means of an intermediate element or piece 35 arranged parallel to the lengthwise axes of the cartridges. Each such intermediate piece 35 interconnects these wall portions 31*a* and 32*a* in a manner such that between the wall portions 31*a* and 32*a* and the intermediate element or piece 35 there is formed in each case a gap section or groove 31*b* and 32*b*, as clearly evidenced by inspecting FIG. 8. Two elastic spring elements 36 and 37 are guided through the gap sections or grooves 31*b*, 32*b* of the individual channel elements 30. These elastic spring elements or elastic guide elements 36 and 37 form side walls of the ammunition channel which are directed perpendicular to the ammunition channel-bending plane and in a manner not here further illustrated, but corresponding to what has been discussed previously with respect to the first exemplary embodiment of FIGS. 1 to 5, are attached at the end elements of the ammunition channel which, as previously mentioned, have been omitted from the showing of FIGS. 6 to 8 to simplify the illustration. The spacing of both guide elements or bands 36 and 37 from one another is smaller than the spacing of the wall portions or sections 31*a* and 32*a* situated opposite one another and arranged at both sides of the cartridges 25.

Having now had the benefit of the foregoing discussion of the various exemplary embodiments of ammunition channel structured according to the invention, their mode of operation will now be considered and is as follows:

With the first exemplary embodiment of ammunition channel, shown in FIGS. 1 to 5, wherein the cartridge axes theoretically are located in the bending plane, the ammunition is deflected with the desired curvature in such a manner that it comes into contact at its base and at its tip with the smooth guide elements or bands 16 and 17. Hence, there is afforded extremely precise guiding of the ammunition in the presence of quite low friction. The few unavoidable slightly step-shaped structured transitions from one element or end element to the other are only present at the walls 9 and 10 arranged parallel to the bending plane and are most likely contacted by rounded parts of the ammunition, so that such does not result in any impairment of the ammunition guiding action or enlargement of the feed resistance. There are only arranged a total of two elements 1 between the end elements 2 and 3, but the ammunition channel still has good flexibility. It would be conceivable however, in the case of a short channel length, to use only one of the channel elements 1, or even in an extreme case to simply hingedly interconnect the end elements 2 and 3 to one another. During curvature of the ammunition channel the guide elements 16 and 17 shift in the recesses 20 and 21 in the end element 2; there is thus also insured for optimum length compensation of the ammunition channel. No contaminants or the like can be entrapped at the smooth guide elements 16 and 17, which otherwise could impair the precision of guiding of the ammunition through the ammunition channel.

With the second exemplary embodiment of ammunition channel, shown in FIGS. 6 to 8, wherein the cartridge axes are disposed essentially perpendicular to the bending plane, the ammunition is deflected or turned through the desired curvature, in such a manner that it contacts at its circumference the elastic guide elements or bands 36 and 37. Here also there is accomplished an extremely precise guiding of the ammunition, in the presence of small feed resistance. The few slightly step-shaped structured transition locations from one element 30 to the other once again are only located at the walls 31 and 32 which are parallel to the bending plane, thereby eliminating the danger that the cartridges 25 can be entrapped or caught at their base or at their trip at such transition locations.

Both exemplary embodiments relate to a two-way channel wherein the cartridge belts 26 can readily slide or move back. This renders possible, for instance, a belt feed from below by means of a suitable feed device, such as a feed or conveyor star or equivalent structure, where there must be insured for disturbance free sliding back of the ammunition belt.

While there are shown and described present preferred embodiments of the invention, it is to be distinctly understood that the invention is not limited thereto, but may be otherwise variously embodied and practiced within the scope of the following claims. Accordingly,

What we claim is:

1. A flexible ammunition channel for the infeed of ammunition between a magazine and a weapon, comprising:

a plurality of elements for forming the ammunition channel;

means for hingedly connecting said elements to one another to form a flexible ammunition channel bendable in only one predetermined bending plane;

said means for hingedly connecting said elements to one another having hinge axes directed essentially perpendicular to said one bending plane of the ammunition channel;

flexible guide bands forming side walls of the ammunition channel and directed essentially perpendicular to said one bending plane;

said elements including a first end element at which there are secured said flexible guide bands;

said elements including a second end element provided with recess means; and said flexible guide bands being guided by said elements and protruding into said recess means of said second end element.

2. The flexible ammunition channel as defined in claim 1, wherein:

part of said elements form two walls extending essentially parallel to said bending plane and having two respective wall portions situated opposite one another and extending perpendicular to said bending plane;

each of said wall portions providing groove means through which there are guided said guide bands.

3. The flexible ammunition channel as defined in claim 2, wherein:

said wall portions, viewed in the lengthwise direction of the ammunition channel, are shorter than the spacing between two successive ones of said hinge means.

4. A flexible ammunition channel for the infeed of ammunition to a weapon, comprising:

a plurality of elements for forming the ammunition channel;

means for hingedly interconnecting said elements to one another to form a flexible ammunition channel bendable in only a single predetermined bending plane;

said means for hingedly interconnecting said elements to one another having hinge axes directed essentially perpendicular to said single bending plane of the ammunition channel;

said plurality of elements having inner side walls directed essentially perpendicular to said single bending plane;

flexible guide bands extending along said inner side walls of all of said plurality of elements;

one of said plurality of elements constituting an end element;

means for securing said flexible guide bands at said one end element; and said flexible guide bands being guided to be lengthwise displaceable through all of the remaining elements.

5. The flexible ammunition channel as defined in claim 4, wherein:

said plurality of elements contain groove means for guiding said flexible guide bands;

said means for hingedly interconnecting said elements comprise respective hinges; and the length of said groove means, viewed in the lengthwise direction of the ammunition channel, being shorter than the spacing between two successive ones of said hinges.

6. The flexible ammunition channel as defined in claim 4, wherein:

ammunition moving through said flexible ammunition channel extends essentially perpendicular to said flexible guide bands.

7. The flexible ammunition channel as defined in claim 4, wherein:

ammunition moving through said ammunition channel extends essentially parallel to said flexible guide bands.

* * * * *